US006625936B2

(12) United States Patent
Schmitz

(10) Patent No.: US 6,625,936 B2
(45) Date of Patent: Sep. 30, 2003

(54) SUN ROOM AWNING

(75) Inventor: Justus Schmitz, Emsdetten (DE)

(73) Assignee: Schmitz-Werke GmbH + Co., Emsdetten (DE)

( * ) Notice: Subject to any disclaimer, the term of this patent is extended or adjusted under 35 U.S.C. 154(b) by 0 days.

(21) Appl. No.: 09/858,461

(22) Filed: May 17, 2001

(65) Prior Publication Data

US 2002/0002800 A1 Jan. 10, 2002

(30) Foreign Application Priority Data

Jul. 8, 2000 (DE) ..... 100 33 419

(51) Int. Cl.[7] ..... E04B 1/34; E04B 7/16

(52) U.S. Cl. ..... 52/74; 52/73; 135/177; 135/88.1; 160/260; 160/67

(58) Field of Search ..... 52/73, 74; 135/177, 135/88.1, 88.11, 88.12; 160/260, 67, 46, 65, 68

(56) References Cited

U.S. PATENT DOCUMENTS

| | | | | | |
|---|---|---|---|---|---|
| 4,576,192 | A | * | 3/1986 | Duda | 135/89 |
| D292,874 | S | * | 11/1987 | Clauss | 52/74 |
| 5,203,393 | A | | 4/1993 | Blevins et al. | |
| 5,369,919 | A | * | 12/1994 | Lohausen | 52/73 |
| 5,752,536 | A | * | 5/1998 | Becker | 135/88.1 |
| 5,873,400 | A | * | 2/1999 | Faller | 160/67 |
| 6,050,280 | A | * | 4/2000 | Jeske | 52/3 |
| 6,269,824 | B1 | * | 8/2001 | Brutsaert | 135/88.12 |
| 6,273,172 | B1 | * | 8/2001 | Frey | 160/67 |
| 6,276,424 | B1 | * | 8/2001 | Frey, Jr. | 160/67 |
| 6,315,025 | B1 | * | 11/2001 | Mabie | 160/22 |
| 6,382,293 | B1 | * | 5/2002 | Brockington et al. | 160/67 |

FOREIGN PATENT DOCUMENTS

| | | | | |
|---|---|---|---|---|
| DE | 3601150 | * | 1/1986 | E04F/10/06 |
| DE | 40 21 264 A1 | | 1/1992 | |
| DE | 93 00 449.4 | | 4/1993 | |
| DE | 93 09 350.0 | | 9/1993 | |
| EP | 0 682 162 A1 | | 11/1995 | |
| EP | 0 778 379 A1 | | 6/1997 | |
| FR | 2558518 | * | 1/1984 | E06B/9/20 |
| FR | 2 563 555 | | 10/1985 | |

* cited by examiner

*Primary Examiner*—Carl D. Friedman
*Assistant Examiner*—Chi A. Nguyen
(74) *Attorney, Agent, or Firm*—Browdy and Neimark, P.L.L.C.

(57) ABSTRACT

In a sun room awning comprising a roll bar for rolling up an awning sheet under formation of a sheet roll and lateral guide rails for guiding the awning sheet while it is being extended, provision is made, to attain a drop-out range, to implement new awning configurations and to avoid the shortcomings of conventional pull systems, for the awning sheet to have push straps with an inherent stiffness in the direction of extension that can be rolled up together with the awning sheet.

9 Claims, 2 Drawing Sheets

SUN ROOM AWNING

BACKGROUND OF THE INVENTION

1. Field of the Invention

The present invention is concerned with a sun room awning comprising a roll bar for rolling up an awning sheet under formation of a sheet roll and lateral guide rails for guiding the awning sheet while it is being extended.

2. Background Art

Sun room awnings of this type serve to provide shade for sun rooms or portions of buildings with large areas of glass.

Conventionally, awnings of this type are equipped with rail-guided back-tension pull systems, i.e., a drop-out rail is pulled out, which is provided at the front end of the awning sheet. Commercially available articulated-arm awnings are used as an alternative.

The known pull systems have the shortcoming that a length difference between the circumference in the unwound condition and the circumference in the wound-up condition must be bridged by an elasticity in the pull system. This is expensive and limits the maximum drop-out range of systems of this type.

SUMMARY OF THE INVENTION

Based thereon, the invention has as its object to create a sun room awning according to the preamble in such a way that the shortcomings of conventional awnings are avoided and the design options are broadened.

This object is met according to the invention in such a way that the awning sheet has push straps that can be wound up together with the awning sheet and possess an inherent stiffness in the direction of extension. It is thus possible to effect the extension of the awning sheet via the drivable roll bar exclusively based on the effect of the push straps. A system of this type avoids the shortcomings of conventional pull systems and it is furthermore possible to attain large drop-out ranges and implement arched shade systems.

In a further development of the invention, provision is made for the push straps to be composed of stainless steel, carbon compound material, or the like. They may be connected to the awning sheet in a continuous connection or at individual points.

The push straps are preferably guided in rails or rail sections that advantageously fit around the push straps in a form-fitting manner.

The push straps advantageously have a thickness approximately corresponding to the thickness of the awning sheet.

The push straps may incorporate series of punched holes, punched-out areas or serrations for corresponding driving, guiding and/or stabilizing means to engage in.

In a preferred embodiment, means are provided along the outer circumference of the push-strap roll to elastically act upon same with a force that is directed radially inward, to thus stabilize the roll and attain an even push-out motion.

These means may be formed by elastically mounted pressure rollers, elastically mounted pressure sliding blocks, or spring-loaded flanged shells that encompass the roll. Alternatively, a tightening strap may be provided that extends around the push strap roll and is spring-loaded, particularly in the tangential direction.

To attain a greater stabilization in the longitudinal direction, the push straps may also have a surface curvature around their longitudinal axis and may optionally also be guided in an appropriately arched guide rail.

The invention will be described in more detail below, based on a preferred embodiment in combination with the drawing.

DESCRIPTION OF THE PREFERRED EMBODIMENTS

Figure 3:
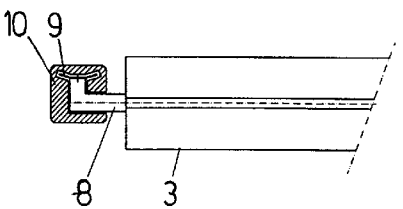
FIG. 3 shows a section of the side area along the section line III—III in FIG. 2.

A sun room awning 1 shown in the drawing comprises an awning sheet 2, which is wound onto a roller bar 3 under formation of a sheet roll 4.

The front end 5 of the awning sheet 2 is connected to a drop-out rail 3' by means of an edge profile 6 and an edge profile groove 7.

The drop-out rail 3' is provided on each side with an L-shaped slider 8, which in turn is connected to a push strap 9 that extends perpendicular to the drop-out rail 3' and is slightly arched around its longitudinal axis, and the slider 8 and the push strap 9 are guided in one of altogether two guide rails 10 such that they slide in a form fitting manner. This ensures the required stiffening of the push strap 9 in the push direction.

Figure 2:
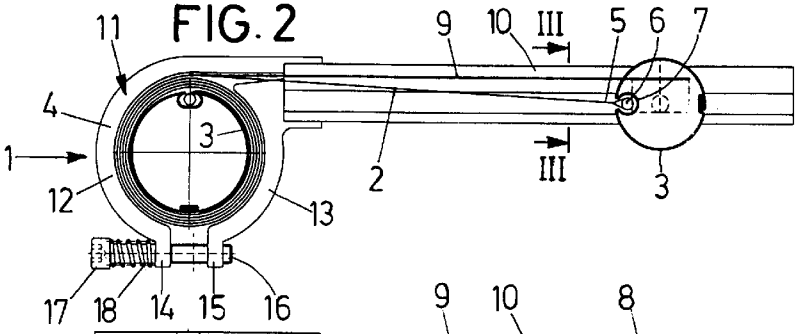
FIG. 2 shows a section through the sun room awning along the section line II—II in FIG. 1.
Figure 1:
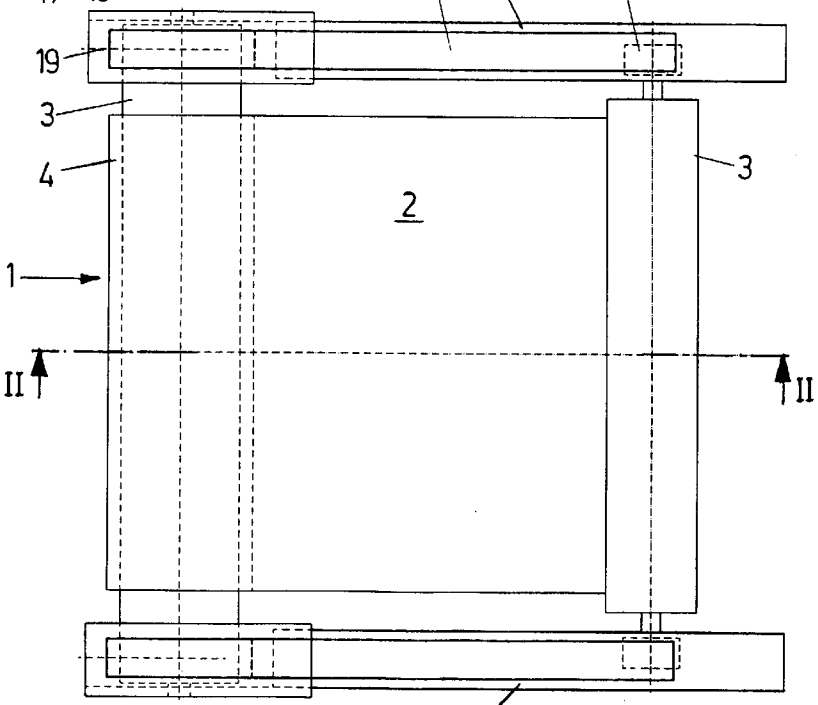
FIG. 1 shows a top view of an inventive sun room awning.

The push strap 9 forms a roll 19 of its own, which, in the embodiment according to FIGS. 1 through 3, is guided by means of a clamp guide 11 comprising two shells 12, 13 that encompass the roll and have flanged projections 14, 15 through which a screw 16 extends, and a coil spring 18 is provided between the screw head 17 of the screw 16 and the flange 14, which ensures that the shells are always forced toward one another and against the push-strap roll 19 50 that an even push-out motion of the push strap 9 is ensured.

The transfer of the drive thrust during the extension process takes place via the drive for the roller bar 3, which acts on the push straps 9 causing them to push, so that, in contrast to the prior art, no pull strap or the like is used to operate the system.

Figure 4:
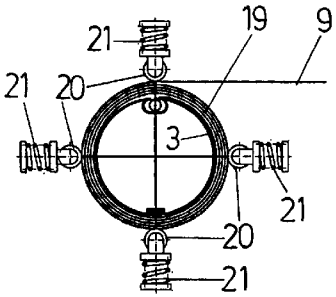
FIG. 4 shows a schematic illustration of an alternative embodiment of the pressure means.

In the embodiment according to FIG. 4, the push strap roll 19 that is wound onto the roller bar 3, is forced radially inward by pressure rollers 20, which are acted upon by coil springs 21.

Figure 5:
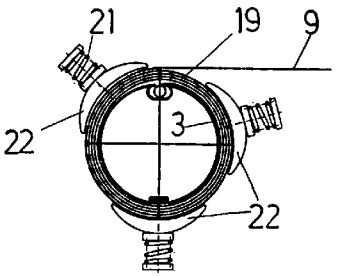
FIG. 5 shows an illustration corresponding to FIG. 4 of a further embodiment.

In the embodiment according to FIG. 5, sliding blocks 22, which extend around the push strap roll 19 in sections in the circumferential direction, are provided in lieu of the pressure rollers 20.

Figure 6:
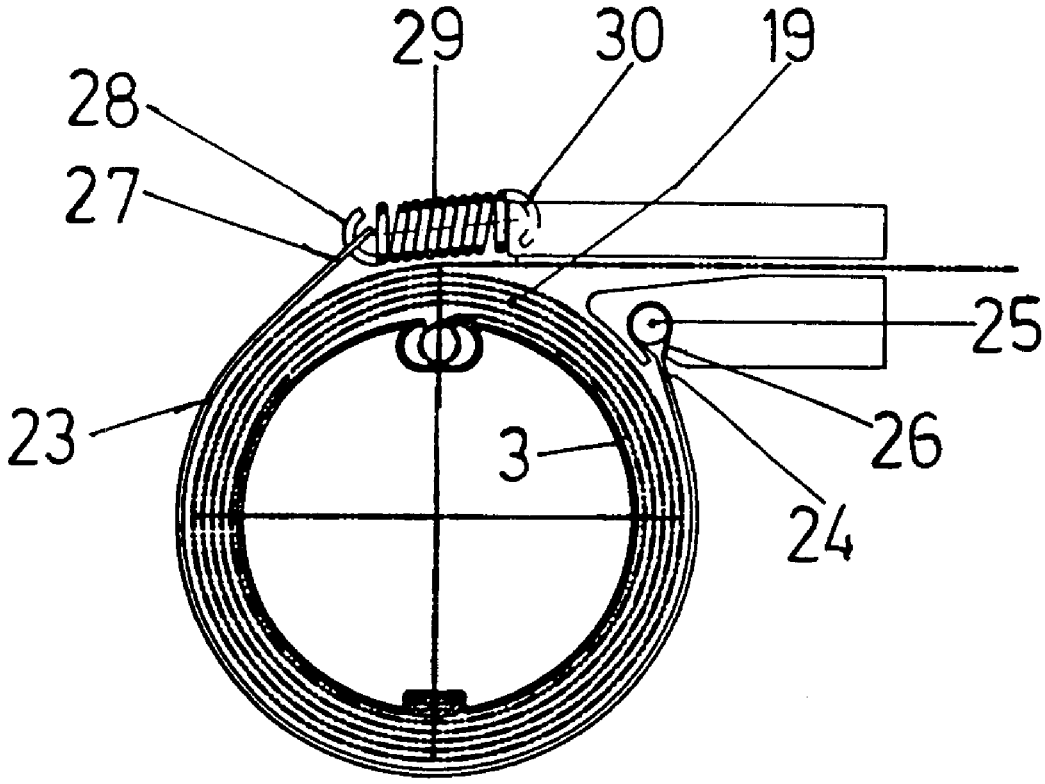
FIG. 6 shows an illustration corresponding to FIG. 4 of a third embodiment.

In the embodiment shown in FIG. 6 a tightening strap 23 is provided that extends around the push strap roll 19. A first end 24 of the tightening strap 23 is provided with an edge profile 25, which is fixed in an edge profile groove 26. The other end 27 is connected via a hook 28 to a coil spring that is arranged nearly tangentially, and the other end of the coil spring 29 is fixed by means of a hook 30.

What is claimed is:

1. A sun room awning comprising a roller bar for rolling up an awning sheet under a sheet roll and lateral guide rails for guiding the awning sheet while being extended, wherein the awning sheet (2) has push straps (9) that can be wound up together with the awning sheet (2) and that have an inherent stiffness along a longitudinal axis thereof and in a direction of extension of the awning sheet which effects extension of the awning sheet when the roller bar is driven to open the awning sheet, wherein the push straps (9) are composed of stainless steel or carbon compound material.

2. The sun room awning according to claim 1, wherein the push straps (9) are connected to the awning sheets in a continuous connection or at individual points.

3. The sun room awning according to claim 1, wherein the push straps (9) are guided in rails (10) or rail sections.

4. The sun room awning according to claim 1, wherein the push straps (9) correspond in their thickness approximately to the thickness of the awning sheet (2).

5. The sun room awning according to claim 1, wherein means are provided along the outer circumference of a push strap roll (19) to elastically force the push strap roll radially inward.

6. The sun room awning according to claim 5, wherein the means for force generation against the push strap roll are formed by elastically mounted pressure rollers (20), elastically mounted pressure slide blocks (22), or spring-loaded flanged shells (12, 13) encompassing the push strap roll.

7. The sun room awning according to claim 1, wherein the push straps (9) have a curvature impressed on them around their longitudinal axis.

8. The sun room awning according to claim 5, wherein a springloaded tension strap (23) are the means around the outer circumference of the push strap roll (19).

9. The sun room awning according to claim 3, wherein the rails or rail sections fit around the push straps in a formfitting manner.

* * * * *